US009702518B2

(12) United States Patent
Guo et al.

(10) Patent No.: US 9,702,518 B2
(45) Date of Patent: Jul. 11, 2017

(54) LED LIGHT SOURCE FOR HEADLAMP

(71) Applicants: Tinglin Guo, Liaoning (CN); Derun Liu, Liaoning (CN)

(72) Inventors: Tinglin Guo, Liaoning (CN); Derun Liu, Liaoning (CN)

( * ) Notice: Subject to any disclaimer, the term of this patent is extended or adjusted under 35 U.S.C. 154(b) by 303 days.

(21) Appl. No.: 14/352,482

(22) PCT Filed: Oct. 19, 2012

(86) PCT No.: PCT/CN2012/083199
§ 371 (c)(1),
(2) Date: Apr. 17, 2014

(87) PCT Pub. No.: WO2013/189136
PCT Pub. Date: Dec. 27, 2013

(65) Prior Publication Data

US 2014/0268857 A1 Sep. 18, 2014

(30) Foreign Application Priority Data

Jun. 21, 2012 (CN) ..... 2012 1 0206706

(51) Int. Cl.
*F21S 8/10* (2006.01)

(52) U.S. Cl.
CPC ..... *F21S 48/115* (2013.01); *F21S 48/1154* (2013.01); *F21S 48/125* (2013.01)

(58) Field of Classification Search
CPC .. F21S 48/1159; F21S 48/1154; F21S 48/115; F21S 48/125; F21S 48/1145; F21S 48/215; F21S 48/00; F21S 48/10; F21S 48/1104; F21Y 2101/02; F21Y 2105/001; F21Y 2113/00; B60Q 2300/41; B60Q 2300/42; B60Q 1/1423; B60Q 2300/3321; B60Q 2400/30; F21W 2101/10; F21V 9/16; F21V 23/00; G02B 19/0061; G02B 19/0066
See application file for complete search history.

(56) References Cited

U.S. PATENT DOCUMENTS 7,686,486 B2 * 3/2010 Tessnow ..... F21K 9/00 362/332
2012/0170299 A1 * 7/2012 Morgenstern ..... B60Q 1/1415 362/521
2013/0010485 A1 * 1/2013 Sikkens ..... B60Q 1/122 362/465

* cited by examiner

*Primary Examiner* — Stephen F Husar

(57) ABSTRACT

An LED light source for headlamp of a motor vehicle is provided. The LED light source is a continuously luminous light band (1). The LED light source is designed into the light band of an area light source by utilizing an imaging principle, in such a manner that structure thereof is simple and an amount of accessories of the headlamp is decreased. The LED light source is low in cost, easy to implement and good in illuminating effect.

8 Claims, 6 Drawing Sheets

LED LIGHT SOURCE FOR HEADLAMP

CROSS REFERENCE OF RELATED APPLICATION

This is a U.S. National Stage under 35 U.S.C 371 of the International Application PCT/CN2012/083199, filed Oct. 19, 2012, which claims priority under 35 U.S.C. 119(a-d) to CN 201210206706.4, filed Jun. 21, 2012.

BACKGROUND OF THE PRESENT INVENTION

Field of Invention

The present invention relates to a light source, and more particularly to an LED light source for headlamp of a motor vehicle.

Description of Related Arts

In the disclosed conventional art, the advanced structures with practical value of the LED headlamp developed all over the world are summarized as follows.

1. Multiple Lens Groups Type

One condenser and one LED form a lens group. The lens group projects a light beam for lighting a light spot on a screen. According to standard requirements for lower beam or upper beam, the light spots generated by multiple lens groups are combined into a light band, so as to meet illumination distribution requirements. This type of structure has a large size, a high price and a difficult process.

2. Free-Face Optical Lens Type

The headlamp comprises a condenser and an LED. However, the condenser is not a surface of revolution, but a free-form surface, in such a manner that the light spots generated by projection of the light beam comply with the illumination standard. This type of structure requires an extremely high luminous density of the LED, wherein the luminous density is an $Lm/mm^2$ value of the luminous surface. This type of structure can be applied in lower headlight, but is difficult to be applied in upper beam.

3. Half Transparent and Half Reflecting Type

This type has same structure as a lens-type HID lamp, wherein the LED only serves as half of an HID lamp which is cut along an axis thereof. This type of structure is only suitable for the lower headlight.

The structures mentioned above reflect a concept that LED is implied as pointolite in the design idea. Therefore, applying the conventional structures of the HID lamp can not obtain satisfactory results.

The LED light source is a typical area light source. A maximum luminous density of a single LED is 100 $Lm/mm^2$, which is practically impossible to reach 200 $Lm/mm^2$. The luminous density of the HID is more than 1000 $Lm/mm^2$, and furthermore, the luminous density of a halogen lamp is more than 400 $Lm/mm^2$.

Therefore, with the LED for serving as a light source, the structures mentioned above are complicated and utility rate of luminous energy thereof is low.

SUMMARY OF THE PRESENT INVENTION

In order to overcome the technical problems mentioned above, the present invention provides an LED light source for headlamp, so as to reduce the consumption of energy, reduce the cost and improve the utility rate of luminous energy.

Accordingly, in order to accomplish the objects mentioned above, the present invention provides an LED light source, wherein the LED light source is a continuously luminous light band.

Luminous density of each point of the light band conforms to a formula of $A \times E1 \times F^2 = E2 \times L^2$, wherein A is a light focusing coefficient of an imaging lens, F is a focal length of the imaging lens, L is a projection distance, E1 is the luminous density of a luminous spot of the light band, E2 is an illumination of a standard requirement of an imaging point on a detecting screen corresponding to the luminous spot E1; coordinate formula of the luminous spot on the light band is: X, Y=coordinate of actual imaging point/magnification, wherein magnification=illuminating distance/focal length of a condenser.

When the light band is a lower light source, the light band is a curved surface.

The light band is an integral whole.

The light band is a split type, and a joint thereof has no luminous dead zone.

A divergence angle of the light band is more than zero degree and less than 60 degree.

When the light band is an upper beam light source, the light band is a flat surface.

When the light band is a lower-upper beam combined light source, the lower beam light source is located in a center of the upper beam light source.

When the lower-upper beam combined light source works as the upper beam light source, luminous illumination of the luminous point is controlled according to the upper beam light source; and when the lower-upper beam combined light source works as the lower beam light source in a control center works according to luminous illumination of the lower beam light source.

Beneficial effect of the present invention is as follows. As shown in FIG. 1 of the drawings, the LED light source is designed into the light band of an area light source by utilizing an imaging principle, in such a manner that structure thereof is simple and an amount of accessories of the headlamp is decreased. The LED light source is low in cost, easy to implement and good in illuminating effect. The present can be implemented even under a low luminous density and with a low cost.

These and other objectives, features, and advantages of the present invention will become apparent from the following detailed description, the accompanying drawings, and the appended claims.

In the Figs mentioned above, 1—light band; 2—imaging lens; 3—lighting area; 4—joint 10—LED light source

DETAILED DESCRIPTION OF THE PREFERRED EMBODIMENT

Combining with the accompanying drawings, further description of the present invention is illustrated as follows.

Embodiment 1

The present invention provides an LED light source for headlamp, wherein the LED source is a continuously luminous light band Luminous density of each point of the light band conforms to a formula of $A \times E1 \times F^2 = E2 \times L^2$, wherein A is a light focusing coefficient of an imaging lens, F is a focal length of the imaging lens, L is a projection distance, E1 is the luminous density of a luminous spot of the light band, E2 is an illumination of a standard requirement of an imaging point on a detecting screen corresponding to the luminous spot E1; coordinate formula of the luminous spot on the light band is X, Y=coordinate of actual imaging point/magnification, wherein magnification=illuminating distance/focal length of the imaging lens. When the light band is a lower light source, the light band is a curved surface. The light band is an integral whole, and a divergence angle of the light band is 45°. An illumination E2 (with a unit Lx) in a lighting area P2 is corresponding to a luminous density E1 (with a unit $Lm/mm^2$) of a conjugate point P1 on the light band.

Figure 1:
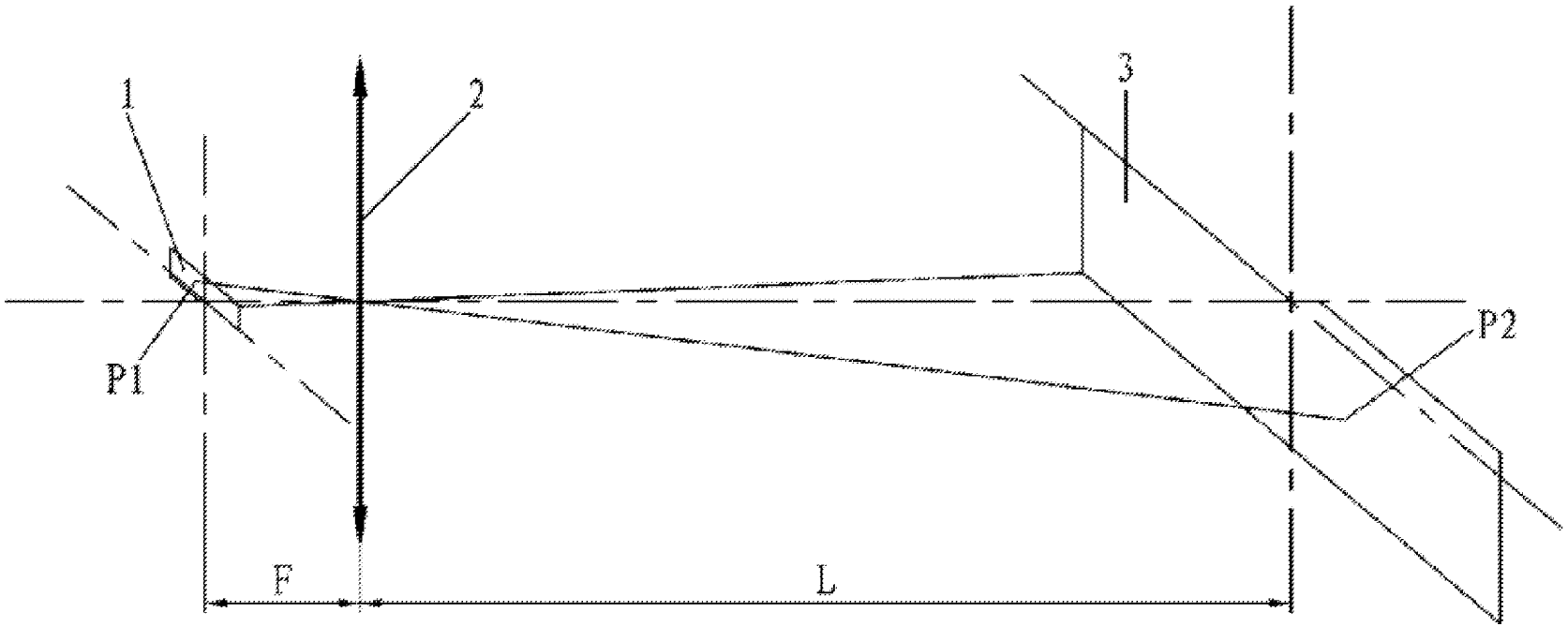
FIG. 1 is a schematic view of an LED light source according to a preferred embodiment of the present invention, while being applied in a headlamp for lighting.
Figure 2:
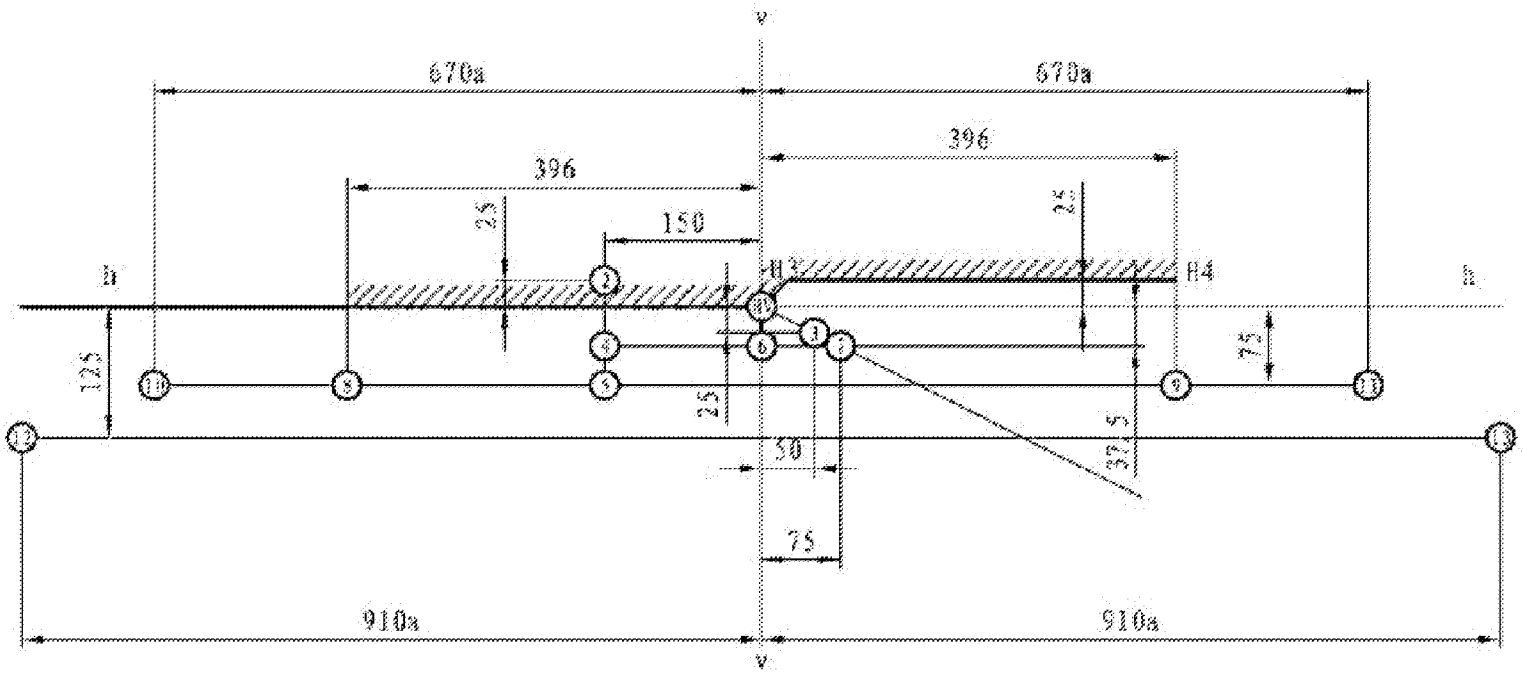
FIG. 2 is a diagram showing illumination requirements of a lower beam lighting area according to a Chinese National Standard GB21259-2007.

FIG. 2 of the drawings shows a test on a detecting screen of a lighting area from 25 meters away. According to a Chinese National Standard, illumination requirements of each test point are shown in Table 1.

TABLE 1

| HV | 3 | 4 | 5 | 6 | 7 | 8 | 9 | 10 | 11 | 12 | 13 |
|---|---|---|---|---|---|---|---|---|---|---|---|
| max 1 Lx | min 20 Lx | max 20 Lx | max 30 Lx | min 12 Lx | min 20 Lx | min 4 Lx | min 4 Lx | min 2 Lx | min 2 Lx | min 1 Lx | min 0.5 Lx |

In the FIG. 2 of the drawings, a dimensional unit is cm. Line h-h and line v-v intersect with a horizontal plane and a vertical plane on the screen which pass through a lower beam datum axis. An angle H3-HV-h is 45°, h-HV-H3-H4 is a light and shade cut-off line in lower beam lighting, h-h is a horizontal center line of a lower beam lighting area, and "a" represents that a size shown in the FIG. 2 is not in scale. According to regulations of a Chinese National Standard GB21259-2007, in the table 1, illumination of an imaging point of HV is not more than 1 Lx, illumination of an imaging point of a test point 4 is not more than 20 Lx, illumination of an imaging point of a test point 5 is not more than 30 Lx. Other values of residual test points are not less than each value in the table 1.

Figure 3:
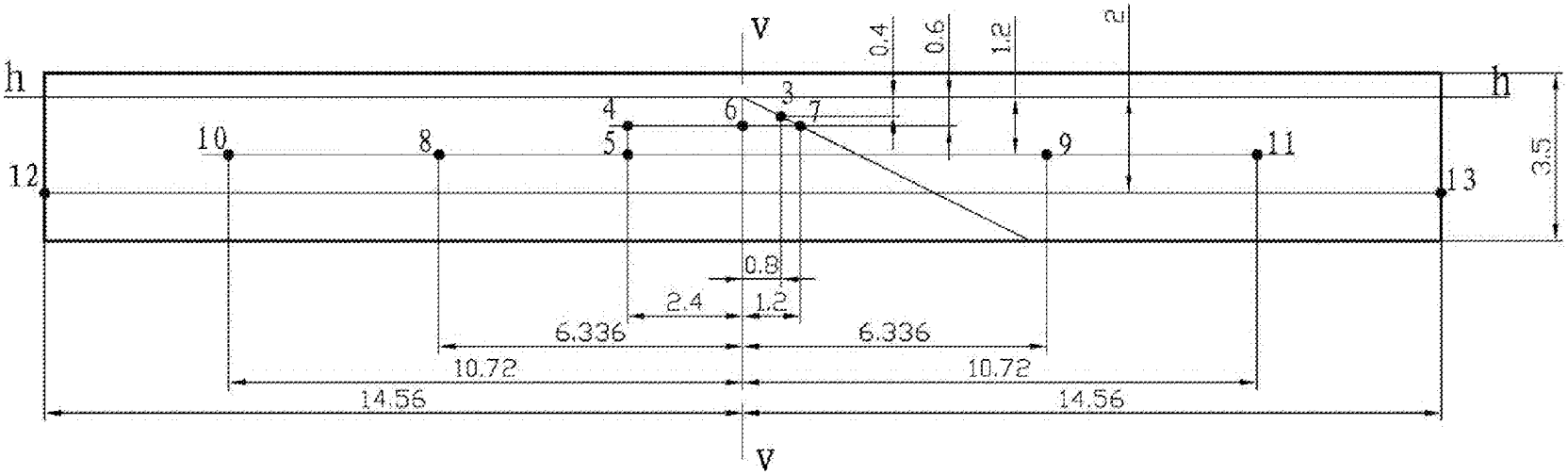
FIG. 3 is a diagram showing the illumination requirements corresponding to FIG. 2 of the drawings when the LED light source of the present invention is utilized.

Taking an imaging lens F=40 mm as an example, coordinates of the light band corresponding to the test point of the lighting area of the FIG. 2 are shown as FIG. 3 of the drawings.

In FIG. 2 of the drawings, a coordinate of a test point 3 is (50, 25). As shown in FIG. 3 of the drawings, coordinate formula of the luminous spot on the light band is X, Y=coordinate of actual imaging point/magnification, wherein magnification=illuminating distance/focal length of a condenser. In FIG. 3 of the drawings, a coordinate of an intersection point of v-v and h-h is (0, 0), wherein v-v is a vertical center line of the light band, h-h is a horizontal center line. A coordinate of a luminous point of the light band is as follows. Magnification=25000/40=625, X, Y=(50, −25)/625=(0.8, −0.4), wherein a unit is mm.

Similarly, coordinate of luminous point 4 (X, Y)=(−2.4, −0.6); coordinate of luminous point 5 (X, Y)=(−2.4, −1.2); coordinate of luminous point 6 (X, Y)=(0, −0.6); coordinate of luminous point 7 (X, Y)=(1.2, −0.6); coordinate of luminous point 8 (X, Y)=(−6.336, −1.2); coordinate of luminous point 9 (X, Y)=(−6.336, −1.2); coordinate of luminous point 10 (X, Y)=(−10.72, −1.2); coordinate of luminous point 11 (X, Y)=(10.72, −1.2); coordinate of luminous point 11 (X, Y)=(10.72, −1.2); coordinate of luminous point 12 (X, Y)=(−14.56, −2); coordinate of luminous point 13 (X, Y)=(14.56, −2); and a projected length of an integral light band is 29.12 mm, and a width thereof is 3.5 mm.

According to a luminous density formula: $A \times E1 \times F^2 = E2 \times L^2$, luminous density of each luminous point on the light band is shown in the following Table 2, wherein a unit thereof is $Lm/mm^2$, light concentrating coefficient A of the imaging lens is 0.45.

TABLE 2

| hv | 3 | 4 | 5 | 6 | 7 | 8 | 9 | 10 | 11 | 12 | 13 |
|---|---|---|---|---|---|---|---|---|---|---|---|
| max 0.86 Lm | min 17.4 | max 17.4 | max 26 | min 10.4 | min 17.4 | min 3.5 | min 3.5 | min 1.7 | min 1.7 | min 0.86 | min 0.43 |

Thus, only under following conditions, the luminous points are capable of meeting requirements of the Chinese National Standard. Values shown in Table 2 are critical values Luminous density of a luminous point hv is no greater than 0.86 $Lm/mm^2$, luminous density of the luminous point 4 is no greater than 17.4 $Lm/mm^2$, luminous density of the luminous point 5 is no greater than 26 $Lm/mm^2$. Other values of residual test points are not less than each value in the table 2.

Embodiment 2

Figure 4:
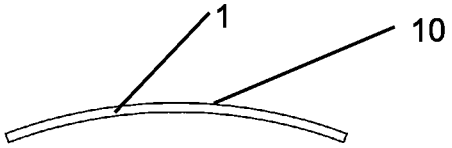
FIG. 4 is a schematic view of a shape of the LED light source of the present invention, showing that a light band is a one piece unit.
Figure 5:
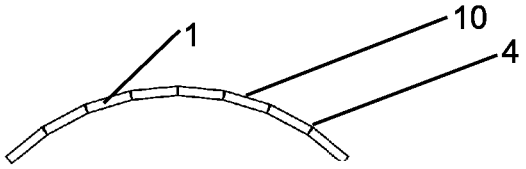
FIG. 5 is a split type schematic view of the LED light source of the present invention, showing that the light band comprises multiple pieces.

The light band in the embodiment 1 is a split type, which is assembled by 8 pieces of light band as shown in FIG. 4 and FIG. 5 of the drawings, wherein a joint thereof has no luminous dead zone, a divergence angle of the light band is 55°. Other conditions are the same as the embodiment 1.

Embodiment 3

A divergence angle of the light band in the embodiment 1 is 5°, other conditions are the same as the embodiment 1.

Embodiment 4

A divergence angle of the light band in the embodiment 1 is 30°, other conditions are the same as the embodiment 1.

Embodiment 5

Figure 6:
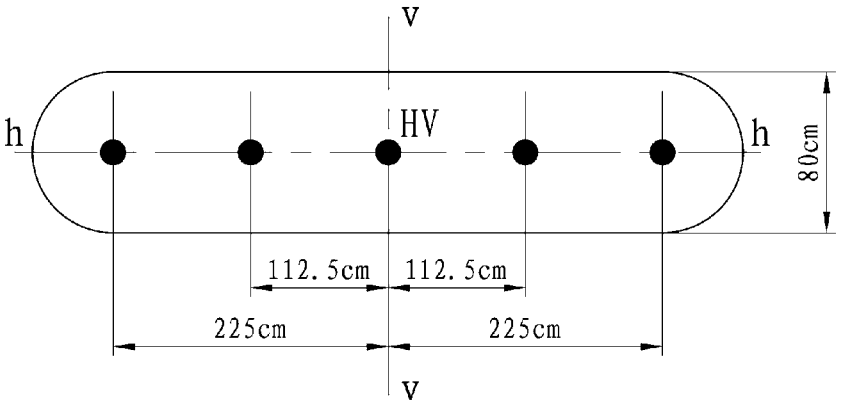
FIG. 6 is a diagram showing illumination requirements of upper beam lighting area according to the Chinese National Standard GB21259-2007.

When the light band in the embodiment 1 is an upper beam light source, the light band is a flat plane. According to a Chinese National standard, the test is processed in a lighting area 25 meters away from the light band. A unit of size in FIG. 6 is cm. Lines h-h and v-v are respectively a horizontal center line and a vertical center line. HV is a center. Two test points on two sides of HV are respectively 112.5 cm and 225 cm away from HV. A divergence angle of the light band is 50°.

Figure 7:
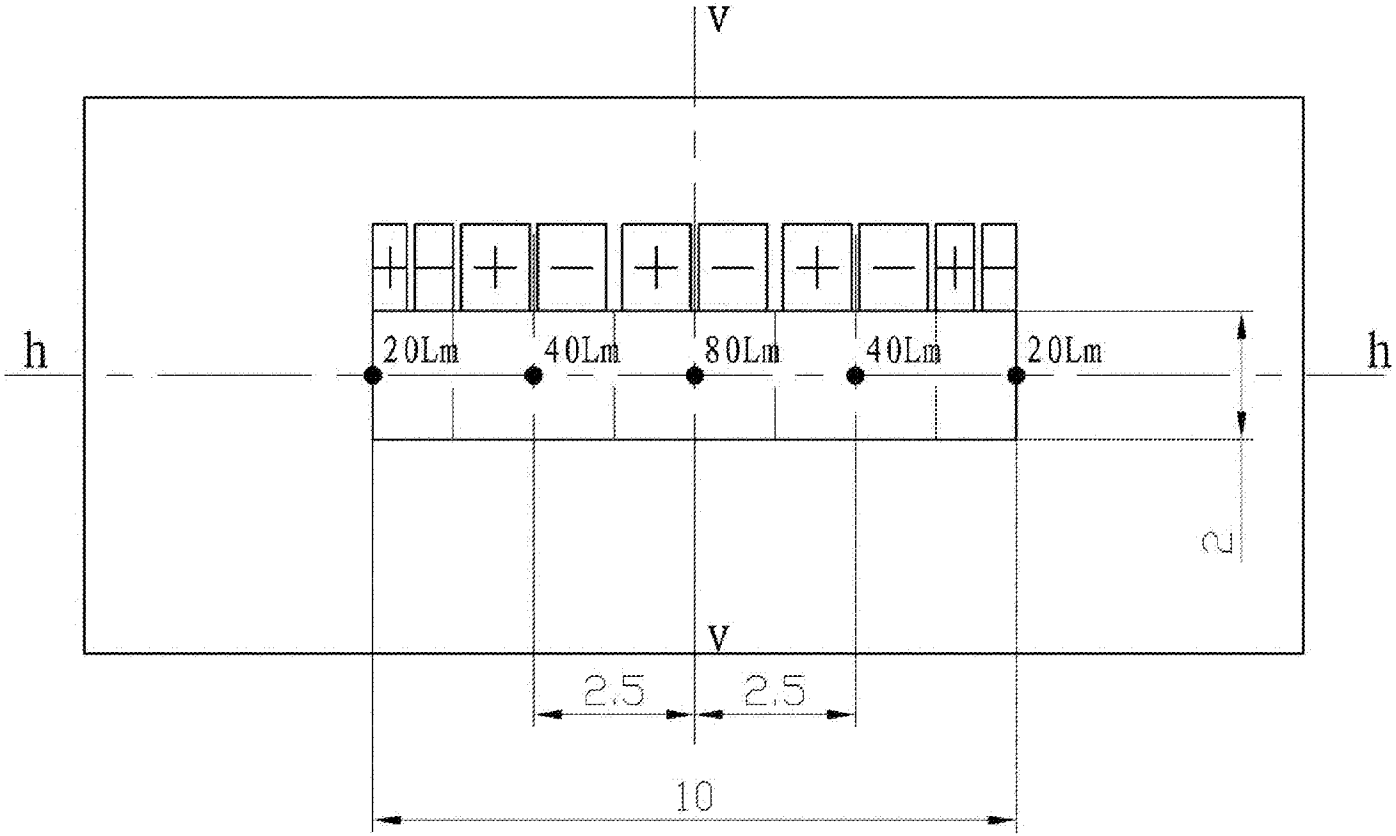
FIG. 7 is upper beam lighting of the present invention which is in accordance with illumination requirements of light band of the FIG. 6.

Referring to FIG. 7 of the drawings, taking an imaging lens F=56 mm as an example, 5 luminous points corresponding to 5 test point in FIG. 6 of the drawings respectively have coordinates of (0, 0), (2.5, 0), (5, 0), (−2.5, 0) and (−5, 0). According to a Chinese National Standard, illumination HV of the 5 test points is 70~180 Lx. HV of points at left and right side is greater than 40 Lx, and HV of two outermost points are more than 10 Lx. According to the formula, luminous density the 5 luminous points on the light band is respectively as follows: luminous density of luminous point (0, 0) of upper-beam light band is 31-80 $Lm/mm^2$, luminous density of luminous points (2.5, 0) and (−2.5, 0) is 18 $Lm/mm^2$, and luminous density of luminous points (5, 0) and (−5, 0) is 4.5 $Lm/mm^2$. A size unit in FIG. 7 of the drawings is mm.

Embodiment 6

Figure 8:
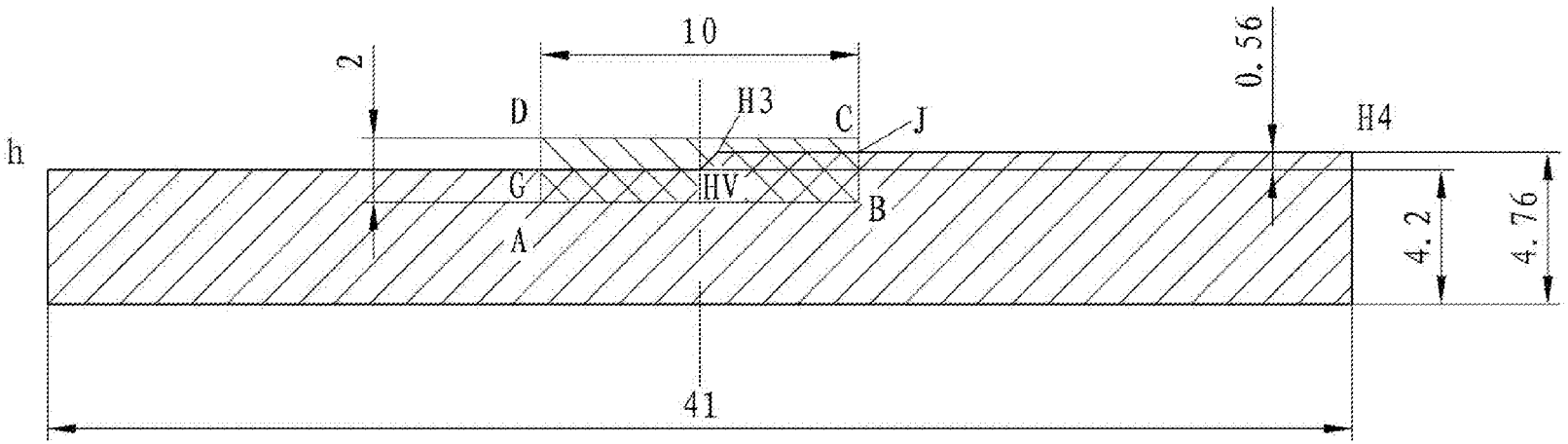
FIG. 8 is a schematic view of a combination whole of lower beam and upper beam of the present invention.

As shown in FIG. 8 of the drawings, when the light band is a combined light source of lower beam and upper beam, the upper beam light band is provided at a center of the lower beam light band. When the lower-upper beam combined light source works as the upper beam light source, luminous illumination of the luminous point is controlled according to the upper beam light source; and when the lower-upper beam combined light source works as the lower beam light source in a control center works according to luminous illumination of the lower beam light source. Line h, HV, H3 and H4 are respectively light and shade cut-off line in lower beam lighting. Lower beam light source, which is produced according to requirements light source of lower headlight, is provided on an area below h, HV, H3 and H4. A, B, J, H3, HV and G are respectively overlap areas of the lower beam lighting and the upper beam lighting. The light and shade cut-off lines, the upper beam lighting area and the lower beam lighting area are packaged together. When the lower headlight is turned on, the light and shade cut-off line appears simultaneously. When the upper beam is turned on, both the lower beam and the upper beam are lighting simultaneously.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An LED (Light Emitting Diode) light source for headlamp, wherein the LED source is a continuously luminous light band;

wherein a divergence angle of the light band is more than zero degrees and less than 60 degrees;

wherein the LED light source further comprises an imaging lens, wherein luminous density of each point of the light band conforms to a formula of $A \times E1 \times F^2 = E2 \times L^2$, wherein A is a light focusing coefficient of the imaging lens, F is a focal length of the imaging lens, L is a projection distance, E1 is the luminous density of a luminous spot of the light band, E2 is an illumination of a standard requirement of an imaging point on a detecting screen corresponding to the luminous spot E1; coordinate formula of the luminous spot on the light band is X, Y=coordinate of actual imaging point/magnification, wherein magnification=illuminating distance/focal length of a condenser;

wherein when the light band is a low light source, the light band is a curved surface;

wherein the light band is a one piece unit.

2. The LED light source for headlamp, as recited in claim 1, wherein the light band comprises multiple pieces, and a joint thereof has no luminous dead zone.

3. The LED light source for headlamp, as recited in claim 1, wherein when the light band is an upper beam light source, the light band is a flat surface.

4. The LED light source for headlamp, as recited in claim 1, wherein when the light band has a low bean light output and a high bean light output, the low beam light source is located in a center of the upper beam light source.

5. The LED light source for headlamp, as recited in claim 4, wherein when the low-high beam combined light source works as the upper beam light source, luminous illumination of the luminous point is controlled according to the upper beam light source; and when the low-high beam combined light source works as the low beam light source in a control center works according to luminous illumination of the low beam light source.

6. The LED light source for headlamp, as recited in claim 1, wherein when the light band is a low light source, the light band is a curved surface, a divergence angle of the light band is 45°.

7. The LED light source for headlamp, as recited in claim 1, wherein the light band is a split type, which is assembled by 8 pieces of light band a joint between 2 of the 8 pieces has no luminous dead zone, a divergence angle of the light band is 55°.

8. An LED (Light Emitting Diode) light source for headlamp, wherein the LED source is a continuously luminous light band;

wherein a divergence angle of the light band is more than zero degrees and less than 60 degrees;

wherein the LED light source further comprises an imaging lens, wherein luminous density of each point of the light band conforms to a formula of $A \times E1 \times F^2 = E2 \times L^2$, wherein A is a light focusing coefficient of the imaging lens, F is a focal length of the imaging lens, L is a projection distance, E1 is the luminous density of a luminous spot of the light band, E2 is an illumination of a standard requirement of an imaging point on a detecting screen corresponding to the luminous spot E1; coordinate formula of the luminous spot on the light band is X, Y=coordinate of actual imaging point/magnification, wherein magnification=illuminating distance/focal length of a condenser;

wherein when the light band is a low light source, the light band is a curved surface;

wherein the light band is a one piece unit;

when the light band has a low beam light output and a high beam light output, the low beam light source is located in a center of the upper beam light source;

wherein the light band is a split type, which is assembled by 8 pieces of light band a joint between 2 of the 8 pieces has no luminous dead zone, a divergence angle of the light band is 55°.

* * * * *